US007739966B2

(12) United States Patent
Ingvarsson

(10) Patent No.: US 7,739,966 B2
(45) Date of Patent: Jun. 22, 2010

(54) DEVICE AND METHOD FOR THE COMBUSTION OF GRANULAR, SOLID FUEL

(75) Inventor: Robert Ingvarsson, Åmål (SE)

(73) Assignee: Janfire AB (SE)

( * ) Notice: Subject to any disclaimer, the term of this patent is extended or adjusted under 35 U.S.C. 154(b) by 427 days.

(21) Appl. No.: 11/290,460

(22) Filed: Dec. 1, 2005

(65) Prior Publication Data

US 2007/0125281 A1 Jun. 7, 2007

(51) Int. Cl.
*F23N 5/02* (2006.01)

(52) U.S. Cl. ..... 110/190; 110/266; 110/259; 110/293; 110/255; 110/165 R

(58) Field of Classification Search ..... 110/185, 110/293, 101 CF, 210, 203, 217, 266, 259, 110/255, 165 R, 281
See application file for complete search history.

(56) References Cited

U.S. PATENT DOCUMENTS

| | | | | |
|---|---|---|---|---|
| 2,118,651 | A * | 5/1938 | Marchi | 250/222.1 |
| 3,276,437 | A * | 10/1966 | Jonakin | 122/392 |
| 4,311,102 | A * | 1/1982 | Kolze et al. | 110/103 |
| 4,717,534 | A | 1/1988 | Morita | 376/419 |
| 5,084,856 | A | 1/1992 | Henmi et al. | 369/116 |
| 7,318,431 | B1 * | 1/2008 | Holtan et al. | 126/7 |
| 2004/0134397 | A1 * | 7/2004 | Ingvarsson | 110/347 |
| 2005/0271988 | A1 * | 12/2005 | Komai et al. | 431/5 |

FOREIGN PATENT DOCUMENTS

SE EP1462721 A2 * 9/2004

* cited by examiner

*Primary Examiner*—Kenneth B Rinehart
(74) *Attorney, Agent, or Firm*—King & Spalding LLP

(57) ABSTRACT

This invention relates to a device (3) for the combustion of granular, solid fuel, for example pellets and the like, comprising; a combustion chamber (16), an air inlet (24) for feeding air to the combustion chamber (16) via at least one air chamber (38,39,40) and at least one air-duct (41,42) for attaining an air flow through the combustion chamber (16), a feeding and dosing arrangement (10, 11, 12) for feeding of the fuel into the combustion chamber (16), an ignition device (28) for ignition of the fuel, a control unit (32) for operation of the combustion device (3) and parts co-operating therewith, an outlet (26) for hot combustion gases from the combustion chamber (16), a movably arranged ash feeder (29) with a drive unit (30), controlled by the control unit (32) for automatic feeding of ashes, unburned fuel, and slag products (31), out of the combustion chamber (16), wherein the ash feeder (29) comprises a movable front part (51) having a perforated bottom which constitutes the above mentioned inner bottom (45), movable between at least an operative position (58), shutting the lower end of the fire place (44), and an ash evacuating position (59), wherein a first temperature sensor (S2) positioned in vicinity of said combustion chamber (16), which first sensor is connected to said control unit (32) arranged to allow activation of said drive unit (30) only if the sensed temperature (T) is below a critical value ($T_{cr}$).

11 Claims, 5 Drawing Sheets

Fig.2
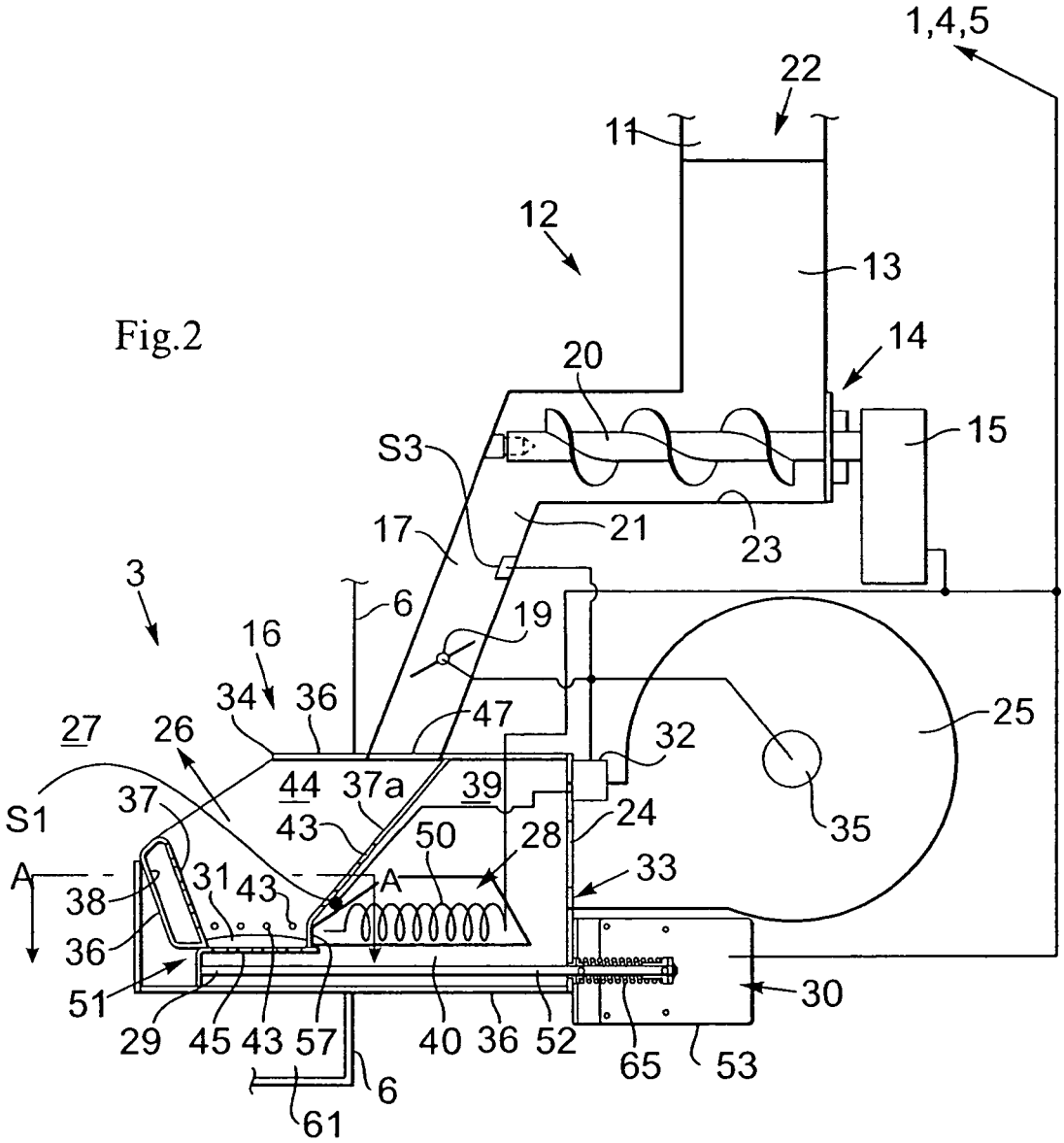
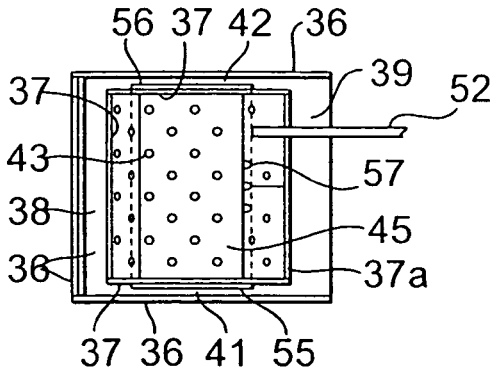
Fig.2a

DEVICE AND METHOD FOR THE COMBUSTION OF GRANULAR, SOLID FUEL

TECHNICAL FIELD

The present invention relates to a device for the combustion of granular, solid fuel, for example pellets and the like, comprising; a combustion chamber, an air inlet for feeding air to the combustion chamber via air chambers and air-ducts for attaining an air flow through the combustion chamber, a feeding and dosing arrangement for feeding of the fuel into the combustion chamber, an ignition device for ignition of the fuel, a control unit for operation of the combustion device and parts co-operating therewith, an outlet for hot combustion gases from the combustion chamber, a movably arranged ash feeder with a drive unit, controlled by the control unit for automatic feeding of ashes, unburned fuel, and slag products, out of the combustion chamber, wherein the ash feeder comprises a movable front part having a perforated bottom which constitutes the above mentioned inner bottom, movable between at least an operative position, shutting the lower end of the fire place, and an ash evacuating position.

PROBLEM PRESENTATION AND BACKGROUND OF THE INVENTION

Combustion devices, also called burners below, of the type specified above are known in different designs in the prior art. A great problem for traditional pellet burners is the sinter formation inside the actual burner. The sintering obstructs the openings in the grate, why this normally must be taken out for cleaning at least once a week, occasionally a lot more often, which of course is a serious disadvantage.

In the prior art there is known a combustion device that substantially reduces the well known problem mentioned above, i.e. of accretion of ashes, unburned residues of fuel and other slag products as sinter by means of a movable ash feeder. However, also in connection with this new kind of burner device there are some problems. Firstly it may happen that malfunction occurs in connection with activation of the moveable ash feeder possibly leading to mechanical breakdown. Moreover it has been discovered that it may be difficult to achieve optimised ignition timing and combustion timing during start up of a burner of this kind due to different flow patterns within the combustion chamber depending on varying parameters, e.g. amount of clogging of perforations, amount of a moisture, temperature of the pellets, etc.

THE OBJECT OF THE INVENTION AND ITS CHARACTERISTICS

The object of the present invention is to achieve a device for combustion of solid granular fuel wherein the above problems have been eliminated or at least minimised, which is achieved by a device for combustion in accordance with claim 1

Thanks to the invention many advantages are gained. Firstly operational problems related to the movable ash feeder may practically be eliminated, since rather surprisingly the use of a temperature sensing means to disable operation of the movable ash feeder unless cooling to a certain temperature level has been achieved, has proven to drastically solve a numeral of experienced mechanical problems related to functioning thereof. Moreover the arrangement of a temperature sensor in close vicinity to the combustion chamber has proven to provide many other advantages such as facilitating optimised control regarding ignition and initiation of combustion.

Further advantages of the invention will be apparent in the following description, but according to some aspects of the invention:

said control unit is arranged to detect ignition by means of said sensor sensing an ignition temperature and/or to detect combustion by means of said sensor sensing a combustion temperature.

a second sensor is connected to said control unit and positioned in said outlet to sense the outlet temperature, arranged to detect that the outlet is in need of cleaning.

a third sensor is connected to said control unit and positioned within said feeding and dosing unit to sense the pellet feeding temperature arranged to control safe shutdown to minimise risk of backfire.

said combustion chamber comprises outer walls as well as inner limiting walls and an inner bottom, which inner limiting walls and inner bottom are provided at a fixed distance from the outer walls for division of the double-walled combustion chamber into a front, a rear, and a lower air chamber, and at least two air ducts provided along longitudinal sides of the combustion chamber, which limiting walls and inner bottom enclose an inner part of the combustion chamber forming a fire place for the combustion of the fuel.

BRIEF DESCRIPTION OF FIGURES

With reference to the annexed figures the invention will be more closely described in the following, in which:

FIG. 2 is a schematic cross-sectional view of a combustion device according to the present invention, which may be used in a central heating system according to FIG. 1, FIG. 2*a* is a cross sectional view along line A-A in FIG. 2.

DETAILED DESCRIPTION OF THE DESIGN

Figure 1:
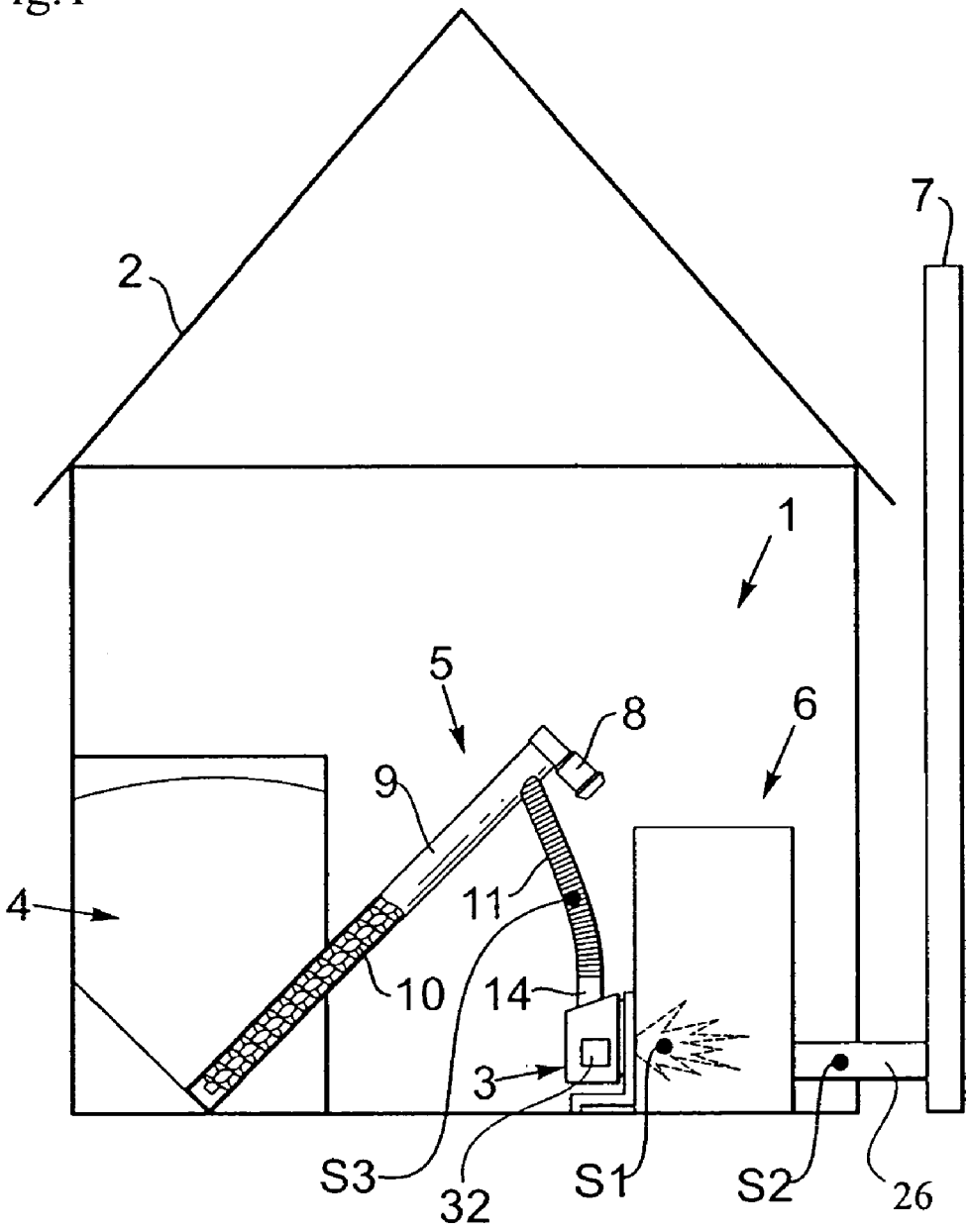
FIG. 1 is a schematic view of parts of a combustion device according to the invention, installed in a conventional central heating system for a house.

With reference to FIG. 1, it is shown a schematic view of parts of a device 3 for combustion of solid fuel in the form of granular materials, which is installed in a conventional central heating system 1 for heating of a house 2. Further there is shown a free standing fuel supply 4, at least one fuel conveyer 5, a conventional heating boiler 6 with a known heating system (not shown), and an outlet 26 to a chimney 7 for the fumes that are created.

The fuel feeder comprises a motor 8 with a transmission box for operation of a feed screw 10, which is revolvably arranged in a feed tube 9 for automatic feeding of fuel from the fuel supply 4 through a down pipe 11, suitably in the form of a flexible hose, to a dosing device 12 in the combustion device 3. The fuel feeder 5 can also be provided with several feed screws 10, but also other types of known fuel feeders can of course be used. Further there is shown a control unit 32 for substantially all-automatic operation of the combustion device 3 and associated parts.

Moreover FIG. 1 shows that three temperature sensors S1, S2, S3, connected to the control unit 32, are arranged at different positions in relation to with the combustion device 3. There is a first sensor S1 arranged in close vicinity in relation to the combustion chamber of the combustion device 3 to sense the temperature $T_c$ within the combustion chamber. Secondly there is a second temperature sensor S2 in the outlet pipe 26 leading to the chimney 7, to sense the temperature $T_o$ in the outlet. Finally there is arranged a third temperature sensor S3 that has as its object to sense the temperature $T_p$ within the inlet 11, 12 of fuel.

In FIG. 2 there is shown a dosing device 12 comprising a fuel feeder 14 having a drive motor 15 for automatic dosage of the fuel into a substantially horizontal combustion chamber 16, through a feeding tube 17. The feeding tube 17, which emerges into the top part of the combustion chamber 16 is preferably in the form of a somewhat inclined fall shaft along which the fuel, after feeding of the correct fuel dose by the fuel feeder 14, falls freely a certain and determined length for prevention of backfire. Additionally a sensor S3 (thermo guard) is positioned within the feeding tube 17 and a damper 19 for closing of the heating tube 17, as will be explained more in detail below.

The combustion device 3 comprises an air inlet 24 with a blowing fan 25 for supply of air to the combustion chamber 16 and an outlet 26 into a boiler section 27 in the heating boiler 6 (not shown). Further there is an automatic ignition device 28 for ignition of the ignition of the fuel, a movably arranged ash feeder 29 with a drive unit 30 for raking out the slag products/ashes.

The control unit 32 comprises processing and memory means (know per se) connected to chosen sensors to achieve the desired function to facilitate a fully automatic system, from the delivery of fuel from the supply 4 to the raking out of the slag products 31 to the ashbin 61 of the heating boiler 6, including the ability to use several pro-programmed power steps, for instance 9, 12, 18, 23 kW, etc.

The blowing fan 25 is mounted at the rear part 33 of the combustion chamber 16 for blowing of air in through said air inlet 24. The combustion chamber 16 comprises partly outer walls 36, which preferably are shaped into a substantially box-shaped combustion chamber 16 on the outside, partly inner walls 37 and a movable inner bottom 45, which is arranged at a determined distance from the outer walls 36 for a division of the thus double-walled combustion chamber 16 in a front, a rear, and a lower air chamber 38, 39, 40 and two air-ducts 41, 42 along the longitudinal sides of the combustion chamber 16. One, several or preferably all of the limiting walls 37 have perforations in the form of smaller apertures and/or larger openings 43 for the through blowing of air. The limiting walls 37, of which several or only one is arranged starting from and with a downwards slope from the inside of, and inwards from, the ceiling 48 of the combustion chamber 16 or from one, several or all of the insides of the outer walls 36, are enclosing an inner and suitably downwardly funnel-formed part 44 of the combustion chamber 16, which inner part together with a bottom 45 constitute a fireplace for the combustion of the fuel. The bottom 45 of the fireplace 44 constitutes the grate, i.e. the usually lattice-formed bottom 45 on which a fuel bed 46 rests during combustion and intermittent or continuous through flowing of air. The muzzle 47 of the feeding tube 17 is suitably arranged in the ceiling 48 of the fireplace 44 and in a near proximity to one or several of the inner insides of the limiting walls 37, of which inner walls 37 one or several have a pitch which is intended to give an alignment towards the fuel bed 46 for the fuel that is falling down in a controlled manner from the dosing device 12 above. The upper and wider tunnel end of the fireplace 44 is open at the front upper part 34 of the combustion chamber 16, into the boiler section 27 and, consequently, constitutes said outlet 26 for the combustion gases mentioned above.

The rear limiting wall 37*a* has air holes 57 into the ignition device 28 for through blowing of air from the blowing fan 25, through the ignition device 28 and further into the fireplace 44. As is shown in FIG. 2 the first temperature sensor S1 is positioned onto the rear limiting wall 37*a*, on the opposite side in relation to the combustion chamber 16. Preferably the sensor S1 constitutes a standardised kind of sensor means, e.g. a so called PT1000 or CRNICR sensor. For example in the form of a plug onto which the corresponding wire is attached and leading to the control unit 32. Thanks to the positioning of the second sensor S1 at this position it can fulfill many functions. Firstly it may be used to disable the control unit 32 to activate the drive unit 30 for the movable ash feeder if the temperature $T_c$, has not dropped below a certain set temperature level, e.g. 80° C. (±20° C.). Thanks to not operating the movable ash feeder until a certain cooling level has been reached the reliability of operation of the movable ash feeder has drastically been increased. It is believed that this is due to a combination of allowing sinter formation to sufficiently cool to not to clog and also allowing heat expansion to be sufficiently reduced to facilitate unobstructed movement of the ash feeder.

Moreover the first sensor S1 may advantageously be used to indicate operation of the ignition device 28, by detecting that a first temperature level has been reached, e.g. $T_c \geqq 80$-90° C. It may also be used to detect that the ignition device 28 has reached a predetermined operational level, e.g. $T_c \geqq 100$-110° C. representing a suitable temperature level to initiate start of the fan 25. Thereafter the sensor S1 may beneficially be used to indicate that combustion of the fuel has been initiated, e.g. $T_c \geqq 120$-130° C. It is understood that all of these different detected levels may be used to achieve optimised operation of the combustion device 3.

Figure 3A:
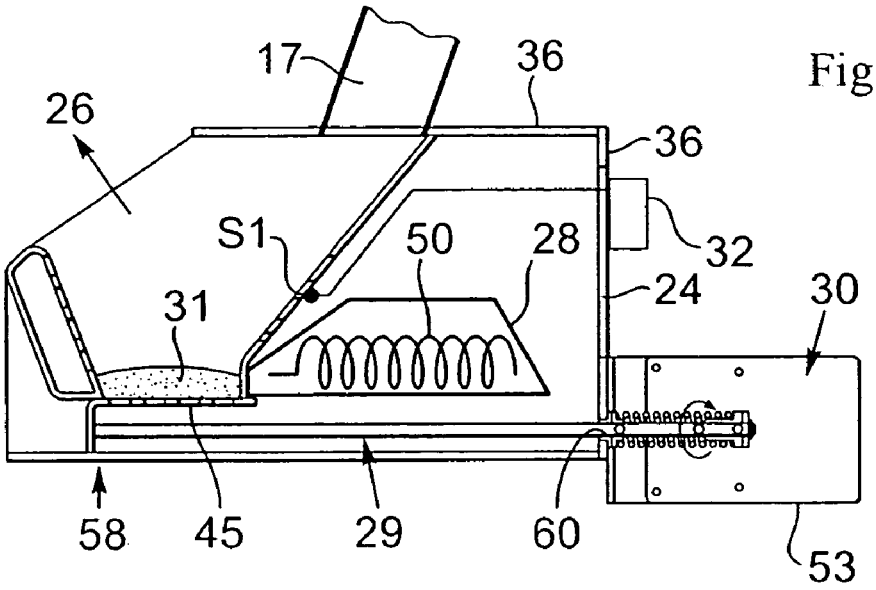
FIG. 3*a-c* shows schematically the course of action for a combustion device according to FIG. 2.
Figure 3B:
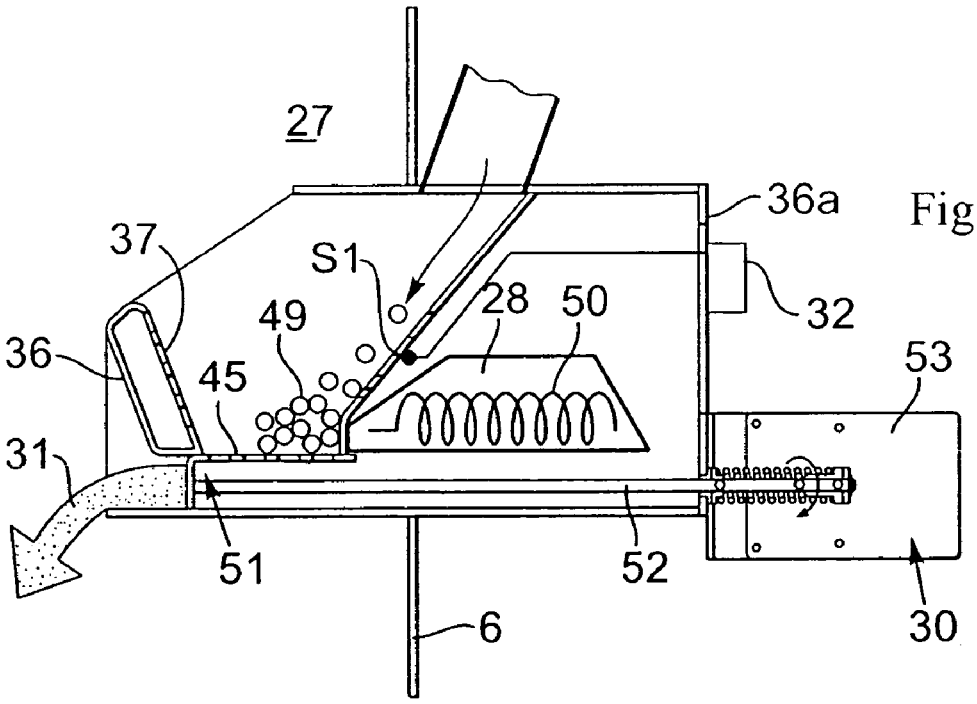
Figure 3C:
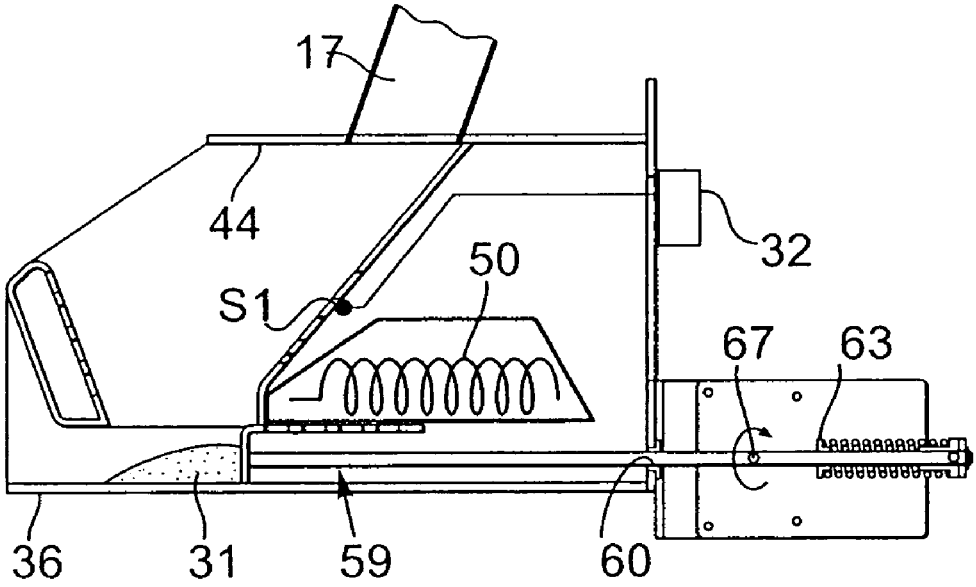

The ash feeder 29 comprises a front part 51, also called rake below, and one or several elongated rods 52 which are attached at and between the front part 51 and the drive unit 30 for feeding of the ashes. The rake 51 and the front end of each rod 52 are arranged in the lower air chamber 40, while the drive unit 30 and the rear end of each rod 52 are arranged in a containment 53 of their own, suitably arranged outside the heat insulated combustion chamber 16 at the rear outer wall 36*a* and having each rod 52 running through a hole 60 in the same 36*a*. The front portion 51 has the shape of an upside down turned box with three sides 54, 55, 56, which box is open in the back, and a perforated bottom that is arranged upwards and which bottom simultaneously constitutes the grate 45 mentioned above. One side 54 constitutes a front edge which is substantially vertical and from which the bottom 45 and the two other sides 55, 56 extend backwards and towards the drive unit 30. The longitudinal sides 55, 56 are arranged at substantially the same distance from the longitudinal outer walls 36 of the combustion chamber 16 as the longitudinal inner limiting walls 37 forming a continuation downwardly of said air-ducts mentioned above. The ash feeder 29 comprises two end positions, one front position, (which position preferably is sensed by means of a sensor, e.g. micro switch not shown)) the operational position 58, at which the rake 51 shuts the lower end of the fireplace 44, see FIG. 3*a*, and a rear position, the ash evacuating position 59, at which the fireplace 44 is almost fully open downwards, see FIG. 3*c*, between which end positions 58, 59 the rake 51 is arranged to be transferred by means of the drive unit 30 via the rods 52. The ignition device 28 may also be arranged with the ash feeder 29, so that the ignition device 28 follows the ash feeder 29 in its reciprocating movements under the fireplace 44.

The function and the use of the combustion device 3 according to the invention is as follows.

By means of the current electronics for the heating boiler 6, and controlled by the control unit 32, the combustion device 3 starts and stops automatically in accordance with the configuration of the operational thermostat of the central heating system 1. Before starting the combustion device 3, the ash feeder 29 has been transferred to its front operational position 58, see FIG. 3*a*, so that the bottom 45 of the fireplace 44 is closed and the fuel feeder 14 has fed fuel to the dosing device 12. At start up, a certain, smaller quantity of fuel is automatically fed by the feed screw 10 to form an ignition composition 49 necessary for ignition of the fire bed 46 on the bottom 45 of the fireplace 44 and in front of the air holes 57 in the rear limiting wall 37*a* into the ignition device 28, see FIG. 3*b*.

The ignition device 28 is initiated, without the motor 35 of the blowing fan 25 being active. When a preset temperature e.g. 90° C. is sensed by the first sensor S1 the control unit will signalise that the ignition is active and working.

When a second temperature level is sensed e.g. 100° C. or alternatively after a set time, e.g. after approx. 2 minutes, the blowing fan 25 starts. When the fuel reaches its ignition temperature caused by the high air temperature, the ignition composition 49 catches fire, which will be sensed and signalised by the first sensor S1 by detecting a present temperature level e.g. 100° C. The operation is then continued by control by means of the control unit 32. For example, at full power, pre-defined fuel doses are fed into the fireplace 44 with intervals so defined that the fuel bed 46 burns continuously. At a lower power requirement, the burner 16 need not to be in operation continuously, but intermittently.

After combustion of fuel and the combustion gases it is desired that substantially all the fuel has been transformed into fumes and merely a small amount of fly ash remaining as a rest, which ash follows the fumes out into the boiler section 27 and into the ash bin 61. However, sinter 31 is created forming a heap on top of the bottom grating 45 of the fireplace 44, i.e. the rake 51. Each new ignition composition 49 increases the heap 31 and, furthermore, it obstructs the holes 43 and the openings 57 making it increasingly more difficult for the hot airflow to get through and start the ignition of every new ignition composition 49.

Figure 4:
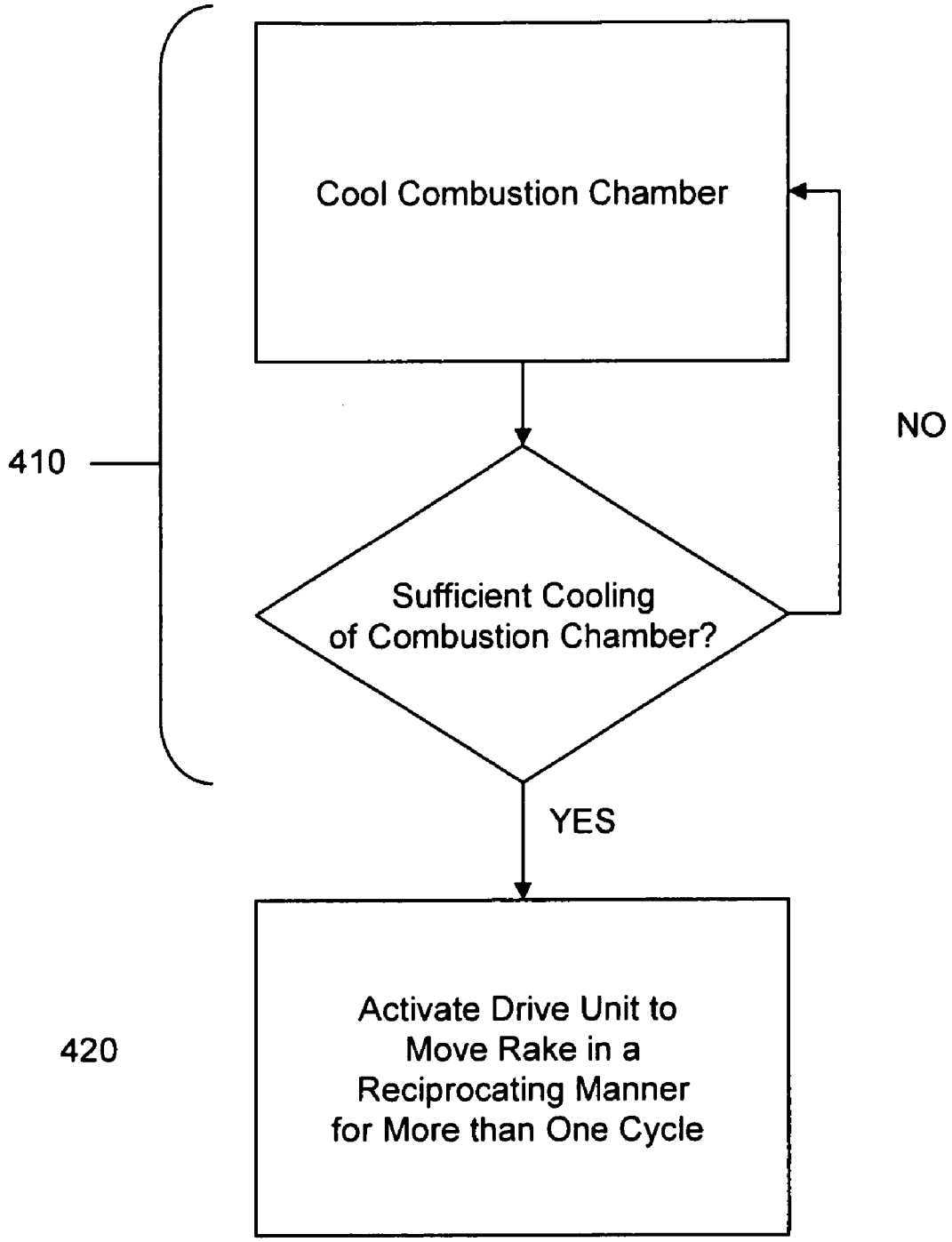
FIG. 4 shows a method according to an exemplary embodiment.

Referring to FIG. 4, before restart, and after sufficient cooling 410 of the combustion chamber 16, the control unit 32 activates the drive unit 30 to move the rake 51 (which rake constitutes both a bottom 45 for the fuel and ash feeder 29 for the sinter products 31) in a reciprocating manner in accordance with a pre-programmed pattern controlled by the control unit 32. In order to achieve optimal conditions for the combustion it is often necessary to reciprocate the ash feeder more than one cycle 420. According to tests that have been performed it is preferred to use at least three reciprocal cycles of the ash feeder 29 to achieve optimal conditions, which may have a drastic influence regarding efficiency of the combustion device. According to a preferred manner air is simultaneously blown by means of the fan 25 into the combustion chamber at least during one of the reciprocating movements of the ash feeder, in order to eliminate obstruction of holes 43 and openings 57. It has shown to be advantageous not to blow air simultaneously in relation to the first reciprocating movement and more preferred the supply of air is merely used in connection with the final reciprocating movement. According to a further beneficial control function of the control unit 32 the program requires three total reciprocating cycles to be completed before the control unit 32 resets the combustion device for a restart. The reason to this is that if for example a large pellet obstructs the movement of the ash feeder 29 several reciprocating movements of the ash feeder might be necessary to first remove the obstructing device. Hence these uncompleted reciprocating movements of the ash feeder 29 will not provide a cleaning of all of the surfaces on and around the ash feeder 29 but merely a portion thereof. Accordingly this feature of the control unit 32 safeguards that efficient cleaning will always be performed. In order to assume sufficient cooling the control unit 32 is programmed not to operate the drive unit 30 unless the first temperature sensor S1 detects that the temperature is below a preset value, i.e. $T_{op}<T_{cr}$.

In the operating position 58, the grate is completely dense along the inner walls 37 in to the fireplace 44, while the grate bin 51 is somewhat wider then the inner walls 37 in order to prevent the fuel to fall outside and beside the grate bin/the rake 51. Initially the rake 51 is moved backwards so that the ashes, the slag and the sinter 31 are scraped of against the rear edge of the inner wall 37*a*, which serves as an anvil, and down in front of the rake 51 while this is moved backwards to its hindmost end position, the ash evacuating position 59. At the ash evacuating position 59, substantially the entire rake 51 is pulled back inside the rear limiting wall 37*a*, after which the rake is made to turn and go back in the forward direction by the drive unit 30, and then at least to its drive position 58 or even further, preferably at least to the level of the front outer wall 36 of the combustion chamber 16, while the ashes, the sinter products and the unburned fuel 31 (slag) are pushed in front of the rake and further down into the ashbin 61 of the heating boiler 6. The rake 51 is then reverted to the initial position, i.e. the operating position 58, to make at least a further reciprocal movement to assure a sufficient cleaning.

Slag feeding is normally performed about approximately every 30 minutes.

If the forward going movement of the rake 51 is blocked by a too large heap of slag products and/or unburned fuel 31, which have fallen down in front of the rake 51 during the backward movement, the spring 65 of the drive unit 30 allows the eccentric to make one complete rotation, after which the control and checking unit 32, or a switch not shown, make sure that the ash evacuating movement is repeated until one complete strike have been obtained for the rake 51, i.e. that the rake 51 is reciprocated between its maximum end position 58, 59, which may be set by the length of the rods 52 used.

A further control function that is provided by the control unit 32 is an improved manner of shutting down the burner not to risk backfire. To achieve this the third sensor S3 is used. Risk of backfire is related to the temperature within the feeding system 11, 12 of the device. In other words, if the temperature within the feeding device exceeds a certain level there is a risk that the pellets within it will take fire. As a consequence the first sensor, acts as a thermo guard S1 and when a certain temperature level is sensed it will signalise to the control unit 32 to shut the damper 19, thereby avoiding direct contact between the combustion chamber 16 and the inlet path 11, 12 for pellets. However, if the burner 3 is operating at top level power there is a risk that the damper 19 will not provide sufficient stop to avoid the risk of backfire. To eliminate this safety risk the control unit 32 is pre-programmed to firstly stepwise bring the power level within the combustion chamber 26 down to a predetermined low level at which the damper 19 can be closed without risking too high temperature that could otherwise lead to backfire despite closing thereof.

According to a further aspect of the control system of the invention, the control unit 32 is pre-programmed to monitor the temperature of the outlet gasses in the outlet 26 by means of the second sensor S2. If the temperature of the outlet gasses within the outlet 26 is above a preset value this is an indication of low efficiency of the boiler and accordingly it is an indication of the need for cleaning of the channels/surfaces of the heat exchanging portion of the boiler.

The invention is not limited to the shown embodiment and it can be varied in different ways within the frame of the claims. It is for instance realized that with a conventional heating boiler 6 it is here for instance meant a so called oil-fired boiler for smaller hoses 2 in which the normal oil burner is replaced by a burner 16 for solid fuel, preferably pellets, and in which the heating system, for instance the existing waterborne system is used in exactly the same way as in normal oil firing. The pellet burner 16 is installed with a connection to the standard drive thermostat of the boiler 6. Of course there is not any limitation made in the use of the combustion device 3, for example into it being used only in already existing boilers 6, why the combustion device may be used in every new installation of applicable central heating systems 1.

The invention claimed is:

1. A device for the combustion of granular, solid fuel comprising:

a combustion chamber, including a fire place, an air inlet for feeding air to the combustion chamber via at least one air chamber and at least one air-duct for attaining an air flow through the combustion chamber, a feeding and dosing arrangement for feeding of the fuel into the combustion chamber, an ignition device for ignition of the fuel, a control unit for operation of the combustion device and parts co-operating therewith, including automatic starts and stops of the combustion device, an outlet for hot combustion gases from the combustion chamber, a reciprocally movable ash feeder with a drive unit, controlled by the control unit for automatic feeding of ashes, unburned fuel, and slag products, out of the combustion chamber at predetermined intervals, wherein the ash feeder comprises a reciprocally movable front part having a perforated plate that enables through flow of air into the combustion chamber, and which plate constitutes an inner bottom, movable between at least an operative position, shutting the lower end of the fire place, and an ash evacuating position, and a first temperature sensor positioned in the vicinity of said combustion chamber and along a wall of the combustion chamber outside of the ash, wherein said first sensor is connected to said control unit such that after an automatic stop of said combustion device, the control unit allows activation of said drive unit only if the sensed temperature is below a critical value.

2. A device according to claim 1, wherein said control unit is arranged to detect ignition by means of said sensor sensing an ignition temperature and/or to detect combustion by means of said sensor sensing a combustion temperature.

3. A device according to claim 1, further comprising a second sensor connected to said control unit and positioned in said outlet to sense the outlet temperature, arranged to detect that the outlet is in need of cleaning.

4. A device according to claim 1, further comprising a third sensor connected to said control unit and positioned within said feeding and dosing arrangement to sense the pellet feeding temperature arranged to control safe shut-down to minimize risk of backfire.

5. A device according to claim 1, wherein said combustion chamber comprises:

outer walls as well as inner limiting walls and the inner bottom, which inner limiting walls and inner bottom are provided at a fixed distance from the outer walls for division of the double-walled combustion chamber into a front, a rear, and a lower air chamber, and at least two air ducts provided along the longitudinal sides of the combustion chamber, which limiting walls and inner bottom enclose an inner part of the combustion chamber forming a fire place for the combustion of fuel.

6. A method for the combustion of granular, solid fuel comprising the following steps:

providing a combustion chamber, including a fire place, providing an air inlet for feeding air into said combustion chamber via at least one air chamber and/or at least one air duct for attaining an air flow through the combustion chamber, providing a feeding and dosing arrangement for feeding of fuel into the combustion chamber, providing an ignition device for ignition of the fuel, providing a control unit for operation of the combustion device and part co-operating therewith, including automatic starts and stops of the combustion device, providing an outlet for hot combustion gases from the combustion chamber, providing a reciprocally movable ash feeder with a drive unit, controlled by said control unit for automatic feeding of ashes, unburned fuel and slag products out of said combustion chamber at predetermined intervals, wherein said ash feeder is provided with a reciprocally movable front part having a perforated plate that enables through flow of air into the combustion chamber, and which plate constitutes at least a portion of an inner bottom within said combustion chamber, said ash feeder being movable between at least an operative position shutting the lower end of the fire place and an ash evacuating position, wherein a first temperature sensor is positioned in the vicinity of said combustion chamber and along a wall of the combustion chamber outside of the ash, and wherein said first temperature sensor is in connection with said control unit, such that after an automatic stop of said combustion device, the control unit allows activation of said drive unit only if the sensed temperature is below a critical value.

7. A method according to claim 6, wherein said control unit is arranged to detect ignition by means of a first sensor sensing an ignition temperature and/or arranged to detect combustion by means of said first sensor sensing s combustion temperature.

8. A method according to claim 6, wherein a second sensor is provided in connection with said control unit and positioned in said outlet to sense the outlet temperature, arranged to detect that the outlet is in need of cleaning.

9. A method according to claim 6, wherein a third sensor is provided in connection with said control unit and positioned within said feeding and dosing arrangements to sense the pellet feeding temperature arranged to control safe shut down to minimize risk of back fire.

10. A method according to claim 9, wherein said control unit is pre-programmed to stepwise decrease the power level of the combustion if said third sensor signals that a certain temperature level is exceeded, and preferably that a damper is arranged within the feed path of the feeding and dosing arrangement to enable closure thereof under the condition that the power lever of the combustion has reached below or in level with a predetermined power level.

11. A method according to claim 6 wherein the control unit is programmed to register at least two completed cleaning cycles of the movable ash feeder, before reset for restart of the burner.

* * * * *